US005921299A

United States Patent [19]

Liu

[11] Patent Number: 5,921,299

[45] Date of Patent: Jul. 13, 1999

[54] FIREWOOD SPLITTING MACHINE

[76] Inventor: Wun-Hui Liu, N0. 2, Jiann Guon Lane, Jiunn Guon Li, Taichung, Taiwan

[21] Appl. No.: 08/985,628

[22] Filed: Dec. 4, 1997

[51] Int. Cl.[6] ..... B27L 7/00

[52] U.S. Cl. ..... 144/195.1; 144/193.1; 144/366; 91/181; 91/410; 60/477; 60/478

[58] Field of Search ..... 144/193.1, 195.1, 144/366; 91/181, 410, 3; 60/477, 478, 479, 481

[56] References Cited

U.S. PATENT DOCUMENTS

| | | | |
|---|---|---|---|
| 3,995,672 | 12/1976 | Binninger | 144/195.1 |
| 4,076,062 | 2/1978 | Kanik | 144/195.1 |
| 4,378,826 | 4/1983 | Beach | 144/195.1 |
| 4,498,293 | 2/1985 | Gregory | 144/195.1 |
| 4,829,865 | 5/1989 | Nunnery et al. | 144/195.1 |
| 5,323,822 | 6/1994 | Janczak | 144/195.1 |

*Primary Examiner*—W. Donald Bray

*Attorney, Agent, or Firm*—Browdy and Neimark

[57] ABSTRACT

A firewood splitting machine is composed of a support frame, a cutter mounted on one end of the support frame, an oil pressure cylinder mounted on another end of the support frame, and an oil injecting device mounted in the support frame. The oil pressure cylinder consists of a cylindrical body, a piston, a rod member, a subsidiary piston, and a subsidiary rod member. The piston is located in the cylindrical body such that an oil pressure space is formed between the piston and a rear end cover of the cylindrical body. The rod member is fastened at one end thereof with the piston such that another end of the rod member is jutted out of a front end cover of the cylindrical body. A pivoting hole is extended along the direction of the longitudinal axis of the rod member such that the pivoting hole is in communication with the oil pressure space. The subsidiary piston is located in the pivoting hole such that the subsidiary piston is fastened with one end of the subsidiary rod member which has another end extending out of the pivoting hole to engage a press plate capable of forcing a wood to move toward the cutter. The oil injecting device is intended to inject oil into the oil pressure space of the oil pressure cylinder.

9 Claims, 8 Drawing Sheets

FIREWOOD SPLITTING MACHINE

FIELD OF THE INVENTION

The present invention relates generally to a wood splitting machine, and more particularly to a firewood splitting machine.

BACKGROUND OF THE INVENTION

The conventional firewood splitting machine is provided with an oil-pressure cylinder for forcing wood to move upwards such that the wood is split into two pieces by a cutter of the firewood splitting machine.

Such a conventional firewood splitting machine as described above is defective in design in that its output of force is rather limited, depending on the piston stroke of the cylinder of the splitting machine. In other words, the output of force of the cylinder of the splitting machine becomes greater if the piston of the cylinder of the splitting machine is provided with a greater area on which the force is exerted. Relatively speaking, the piston stroke of the oil-pressure cylinder of the conventional firewood splitting machine must be shortened for each oil-supplying action to enable the oil-pressure cylinder to have a high output of force. As a result, the splitting of firewood is done easily; nevertheless the splitting of firewood takes longer to accomplish. On the other hand, if the piston of the oil-pressure cylinder of the conventional firewood splitting machine is provided with a relatively smaller area on which the force is exerted, the piston stroke of the oil-pressure cylinder is made faster. As a result, the piston stroke is made longer for each oil-supplying action, thereby causing the oil-pressure cylinder to have a low output of force. This means that the splitting of firewood is done faster, and that the splitting of firewood requires a greater effort. To sum up, the conventional firewood splitting machine is bound to encounter difficulty in splitting a wood of rigid texture.

SUMMARY OF THE INVENTION

The primary objective of the present invention is to provide an improved firewood splitting machine capable of producing a maximum output of force at the outset and capable of reducing the output of force as soon as the wood is split.

In keeping with the principle of the present invention, the foregoing objective of the present invention is attained by a firewood splitting machine, which is composed of a support frame, a cutter, an oil pressure cylinder, and an oil injecting device. The oil pressure cylinder is provided with a piston, a rod member, a subsidiary piston, a subsidiary rod member, and a press plate. The rod member is fastened at one end thereof with the piston such that another end of the rod member juts out of a front end cover of the cylinder. The cylinder is provided with a through hole extending along the direction of the longitudinal axis of the rod member such that the through hole is in communication with an expandable chamber located within the cylinder between the piston and a rear end cover of the cylinder. The subsidiary piston is located in the through hole. The subsidiary rod member is fastened at one end thereof with the subsidiary piston such that another end of the subsidiary rod member juts out of the through hole and that another end of the subsidiary rod member is engaged with the press plate for forcing wood to move toward the cutter. As the oil is injected by the oil injecting device into the oil pressure space of the cylinder, the piston and the subsidiary piston are driven to displace the rod member and the subsidiary rod member to produce simultaneously the maximum output of force for forming a line of cleavage in the wood. As soon as the piston has arrived at the end of the piston stroke, the output of force of the subsidiary piston becomes smaller. In the meantime, the movement of the subsidiary rod member becomes faster, so as to enable the firewood splitting machine to accomplish the splitting of the wood at full speed.

DETAILED DESCRIPTION OF THE INVENTION

Figure 1:
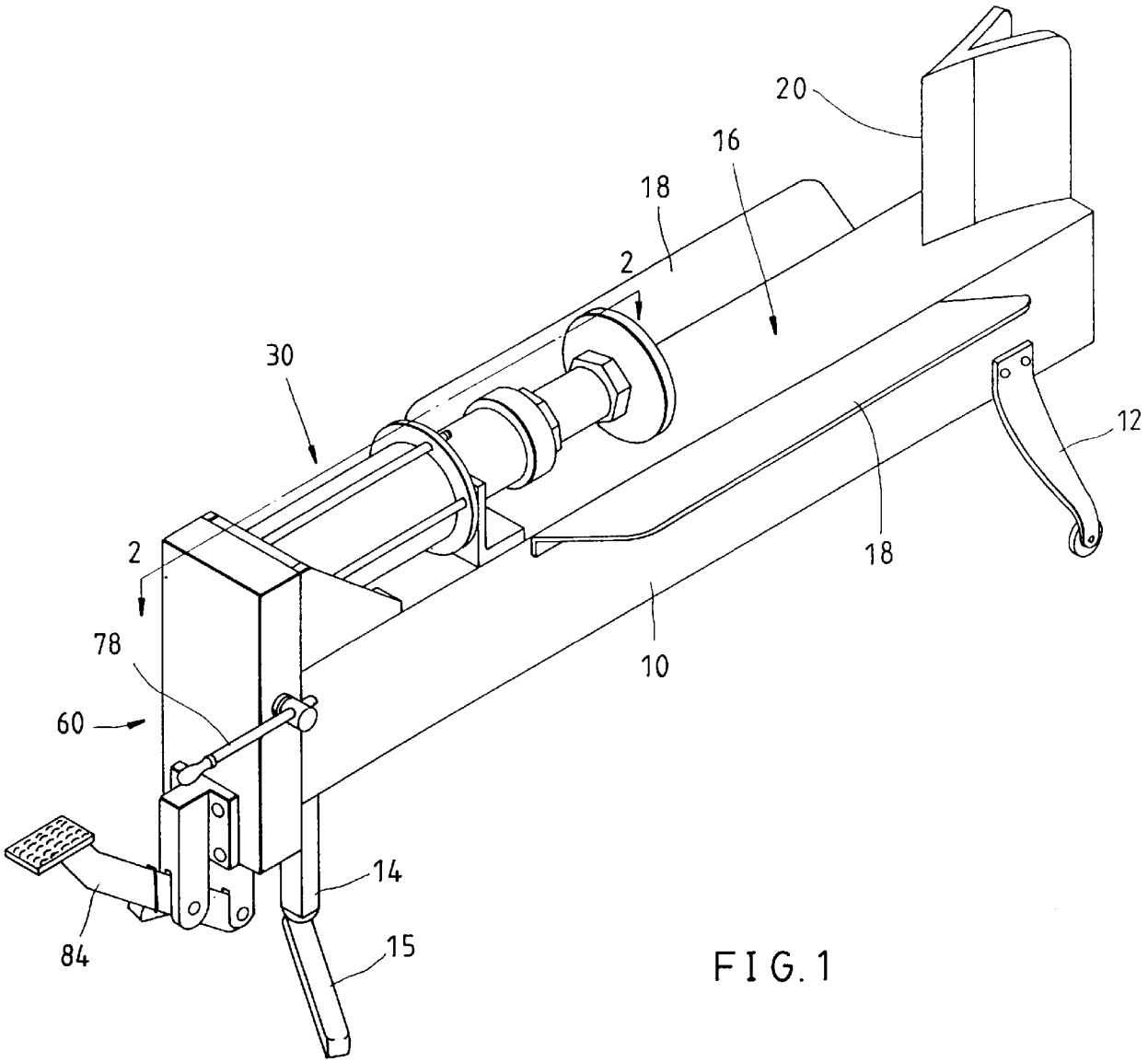
FIG. 1 shows a perspective view of a first preferred embodiment of the present invention.
Figure 2:
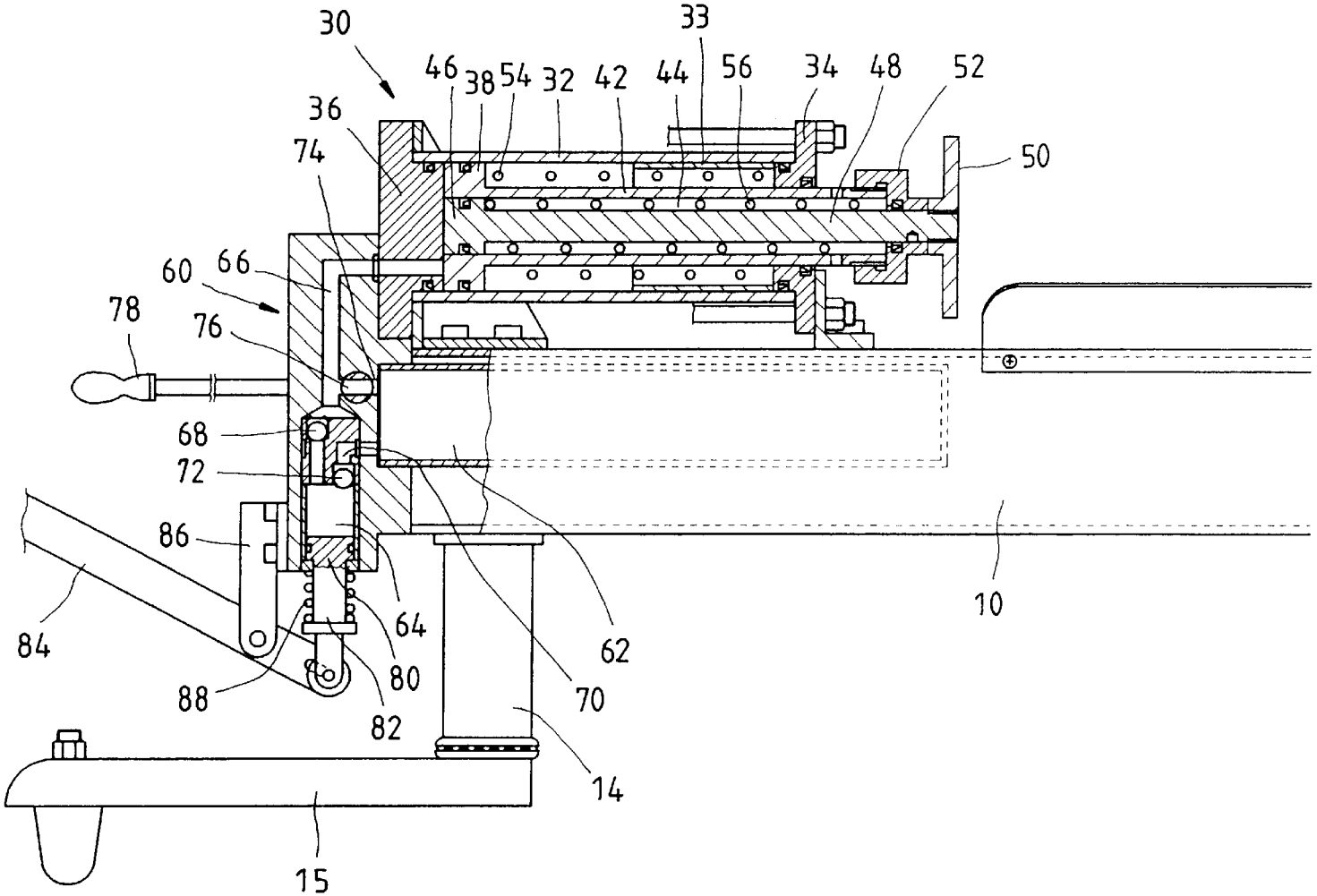
FIG. 2 shows a sectional view of a portion taken along the direction indicated by a line 2—2 as shown in FIG. 1.

As shown in FIGS. 1 and 2, a firewood splitting machine of the first preferred embodiment of the present invention is composed of the component parts, which are described hereinafter.

A support frame 10 of a rectangular construction is provided at both ends of a longitudinal axis thereof with support legs 12 and 14. The support leg 14 is provided at the free end thereof with an auxiliary leg 15 fastened rotatably therewith.

A V-shaped cutter 20 is mounted on one end of the longitudinal axis of the support frame 10.

As shown in FIGS. 1 and 2, an oil pressure cylinder 30 is mounted on another end of the longitudinal axis of the support frame 10 such that a firewood placing area 16 is formed between the cutter 20 and the oil pressure cylinder 30. The firewood placing area 16 is provided respectively at both sides thereof with a side plate 18. The oil pressure cylinder 30 consists of a cylindrical body 32 provided with a front end cover 34 and a rear end cover 36, a piston 38 located in the cylindrical body 32 such that an expandable chamber 40 (as shown in FIGS. 5 and 6) is formed by oil pressure between the piston 38 and the rear end cover 36, a rod member 42 fastened at one end thereof with the piston 38 such that another end of the rod member 42 juts out of the front end cover 34 and that the rod member 42 is capable of displacing along with the piston 38, a through hole 44 extending in the direction of the longitudinal axis of the rod member 42 such that the through hole 44 is extended through both ends of the rod member 42 and the piston 38 and that the through hole 44 is in communication with the expandable chamber 40, a subsidiary piston 46 located movably in the through hole 44, a subsidiary rod member 48 fastened at one end thereof with the subsidiary piston 46 such that another end juts out of the through hole 44 to engage with a press plate 50 capable of forcing wood to move toward the cutter 20, a subsidiary rod member end piece 52 fastened with the exposed end of the rod member 42 for slidably engaged the subsidiary rod member 48, a recovering spring 54 having one end urging the front end cover 34 and having another end urging the piston 38, and a subsidiary spring 56 urging at one end thereof the subsidiary rod member end piece 52 and urging at another end thereof the subsidiary piston 46.

An oil injecting device 60 is composed of an oil storage cylinder 62 concealed in the support frame 10, an oil injecting chamber 64, an oil injecting pathway 66 in communication with the oil injecting chamber 64 and the expandable chamber 40, an oil check valve 68 located in the oil injecting pathway 66 to allow the flow of oil in one-way manner that the oil is injected into the expandable chamber 40 from the oil injecting chamber 64 via the oil injecting pathway 66, an oil supplying pathway 70 in communication with the oil storage cylinder 62 and the oil injecting chamber 64, an oil supplying check valve 72 located in the oil supplying pathway 70 to allow the one-way flow of the oil from the oil storage cylinder 62 to the oil injecting chamber 64 via the oil supplying pathway 70, an oil returning pathway 74 in communication with the oil storage cylinder 62 and the expandable chamber 40 or the oil injecting pathway 66 located between the oil injecting check valve 68 and the expandable chamber 40, an oil returning switch 76 located at the oil returning pathway 74 for opening or closing the oil returning pathway 74 and provided with an actuating rod 78 which is linked with the switch 76, an oil injecting piston 80 slidable in the oil injecting chamber 64 for pumping the oil in the oil injecting chamber 64 into the expandable chamber 40 and provided with a piston rod 82 fastened with the oil injecting piston 80 such that the free end of the piston rod 82 is exposed, a press rod 84 fastened pivotally at one end thereof with the exposed free end of the piston rod 82 such that a portion adjoining to the pivotal end of the press rod 84 is fastened with a support piece 86 which is in turn fastened with the support frame 10, and that another end of the press rod 84 can be pressed with a foot, and a recovering spring 88 urging at one end thereof the outer wall of the oil injecting chamber 64 and urging at another end thereof the piston rod 82, so as to enable the oil injecting piston 80 to return to its original position after being displaced.

Figure 4:
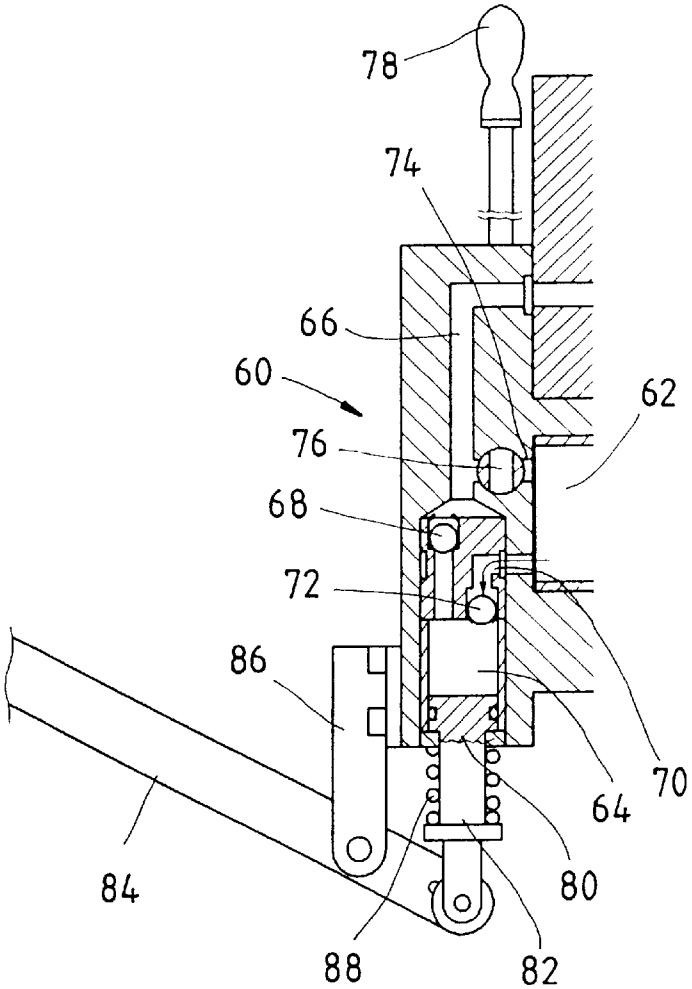
FIGS. 3 and 4 are schematic views illustrating the action of the oil injecting device of the first preferred embodiment of the present invention.
Figure 3:
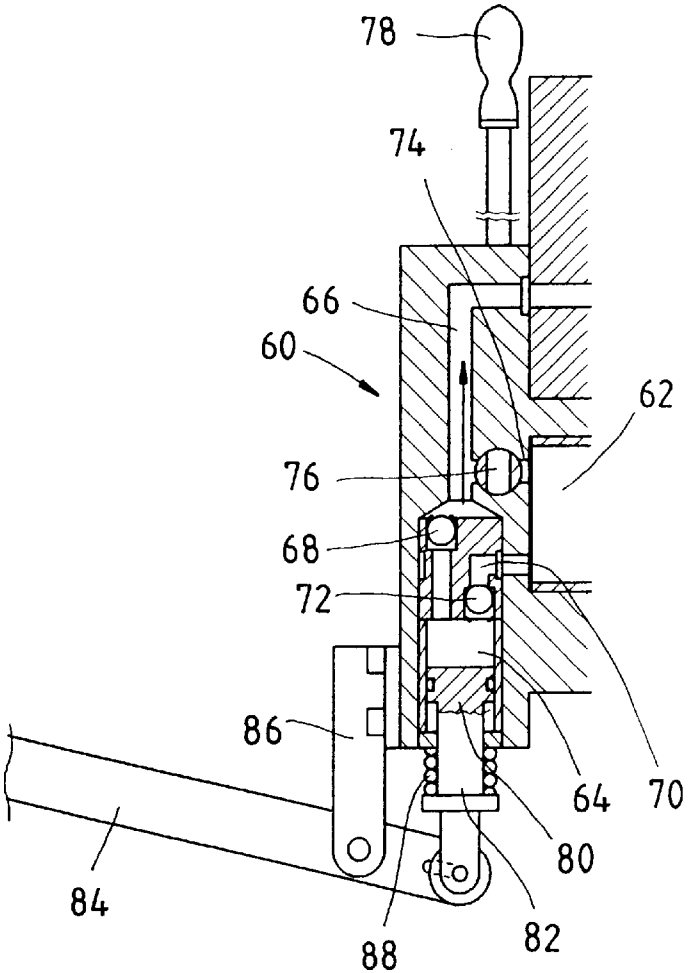

As illustrated in FIGS. 3–6, prior to the operation of the machine of the present invention, the wood of an appropriate size is located at the firewood placing area 16. Thereafter, the actuating rod 78 is pushed upward to locate at the position as shown in FIGS. 3 and 4, thereby actuating the oil returning switch 76 to shut off the oil returning pathway 74. As the press rod 84 is pressed by the foot of an operator, the oil injecting piston 80 is thus pushed upward, as shown in FIG. 3, thereby compressing the oil in the oil injecting chamber 64. In the meantime, the steel ball of the oil supplying check valve 72 is pushed upward by the oil pressure to allow the oil to be injected into the expandable chamber 40 via the oil injecting pathway 66. Now referring to FIG. 4, as soon as the press rod 84 is relieved of the external force exerting thereon, the oil injecting piston 80 is forced by the elastic force of the recovering spring 88 to move downward, as shown in FIG. 4, so as to cause the free end of the press rod 84 to turn upward. In view of the vacuum suction formed by the expanded space of the oil injecting chamber 64 and the force of gravity, the steel balls of the check valves 68 and 72 are caused to move downward to shut off the oil injecting pathway 66. In the meantime, the oil supplying pathway 70 is opened up to allow the oil in the oil storage cylinder 62 to flow into the oil injecting chamber 64. The oil in the expandable chamber 40 remains unchanged. The oil is injected into the expandable chamber 40 by pressing the press rod 84 repeatedly, so as to drive the piston to displace.

Figure 5:
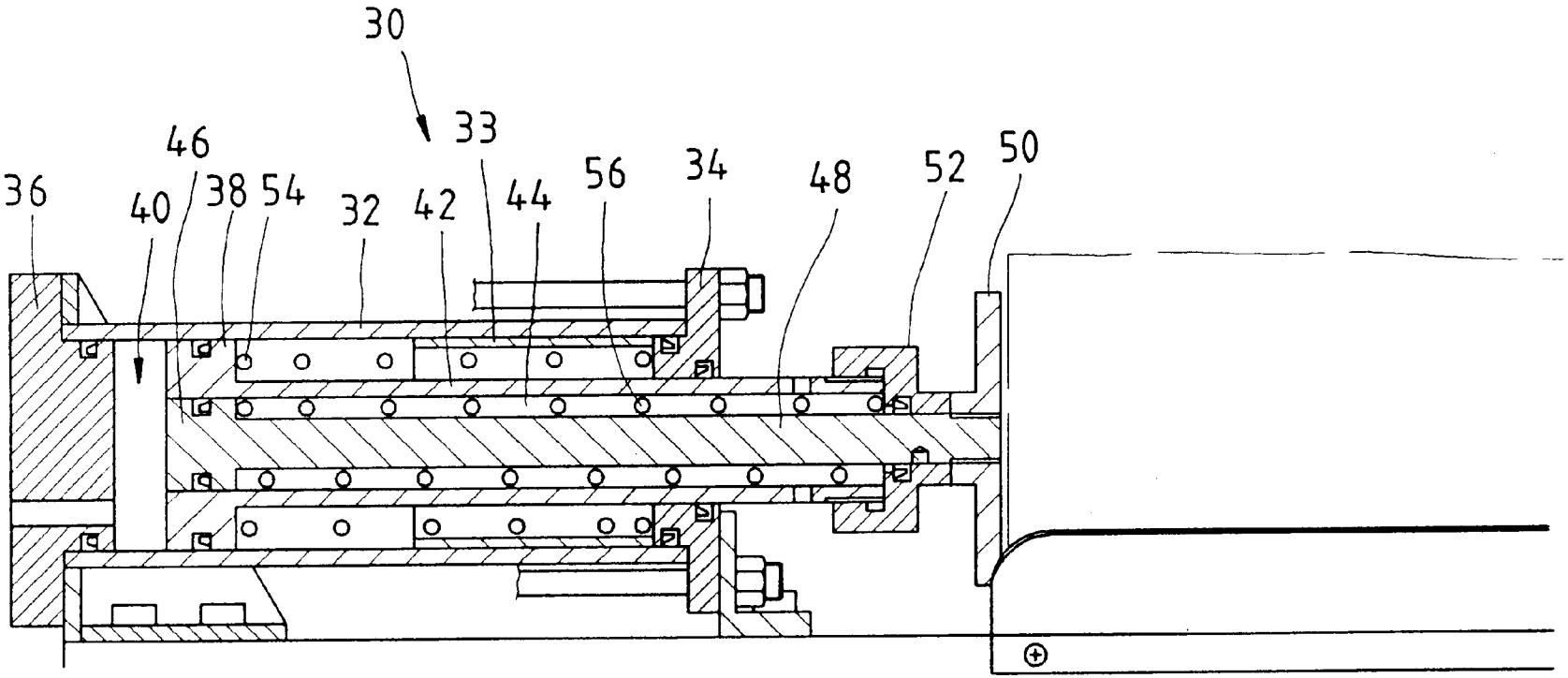
FIGS. 5 and 6 are schematic views illustrating the action of the oil pressure cylinder of the first preferred embodiment of the present invention.
Figure 6:
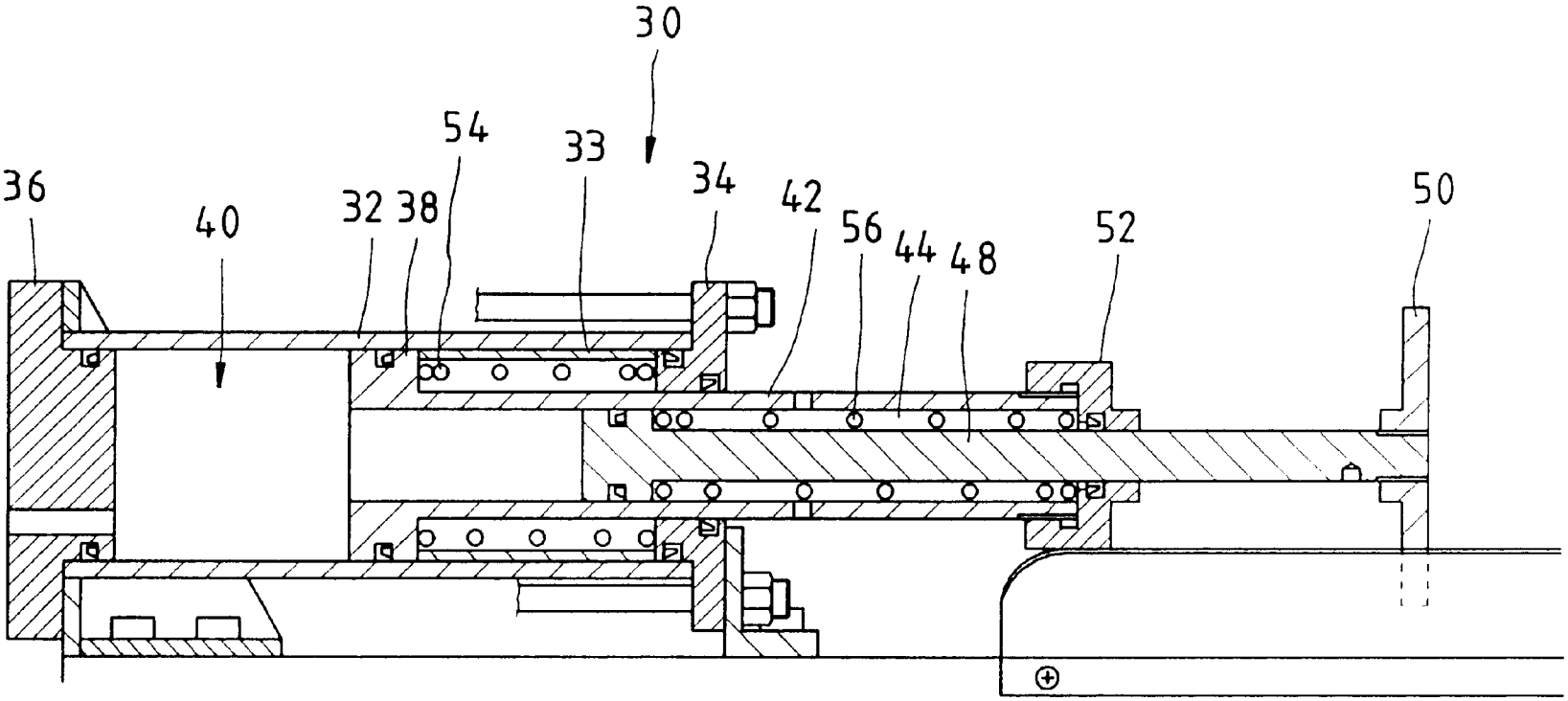

As shown in FIG. 5, the piston 38 and the subsidiary piston 46 are driven to move toward the right side of the drawing after the oil is injected into the expandable chamber 40. As a result, the wood is pushed by the press plate 50 to press against the cutter 20. As the press rod 84 is kept being pressed by the operator's foot, the pistons 38 and 46 continue to displace such that press plate 50 exerts a maximum force on the wood to bring about a line of cleavage in the wood by the cutter 20.

As illustrated in FIG. 6, when the piston 38 is obstructed by the front end cover 34, a locating member 33 of the cylindrical body 32 serves as a front stopping point of the piston 38. Only the subsidiary piston 46 can continue to displace along the through hole 44. In the meantime, the motion of the subsidiary rod member 48 becomes faster to result in the splitting of the wood at full speed. As soon as the wood is completely split, the actuating rod 78 is returned to the position, as shown in FIG. 2, to open up the oil returning pathway 74. The pistons 38 and 46 are forced by the elastic force of the springs 54 and 56 to return to their original positions. The oil in the expandable chamber 40 is thus able to flow back into the oil storage cylinder 62 via the oil returning pathway 74.

The splitting of another wood can be carried out by repeating the operation described above. In other words, the wood is first located in the wood placing area 16 while the oil returning switch 76 is turned off. The actuating rod 78 is kept in the upright position before the press rod 84 is pressed continuously to carry out the operation of splitting the wood.

The operational efficiency can be enhanced by providing the firewood splitting machine with a replaceable press plate 50 or by providing the press plate 50 with additional pad for reducing the gap between the wood and the press plate 50.

The subsidiary piston and the subsidiary rod member of the present invention can be further provided with a second subsidiary piston and a second subsidiary rod member. As a result, the oil pressure cylinder of the firewood splitting machine of the present invention may be provided with a series of pistons and rod members to enable the oil pressure cylinder to operate in a multi-stage manner.

Figure 7:
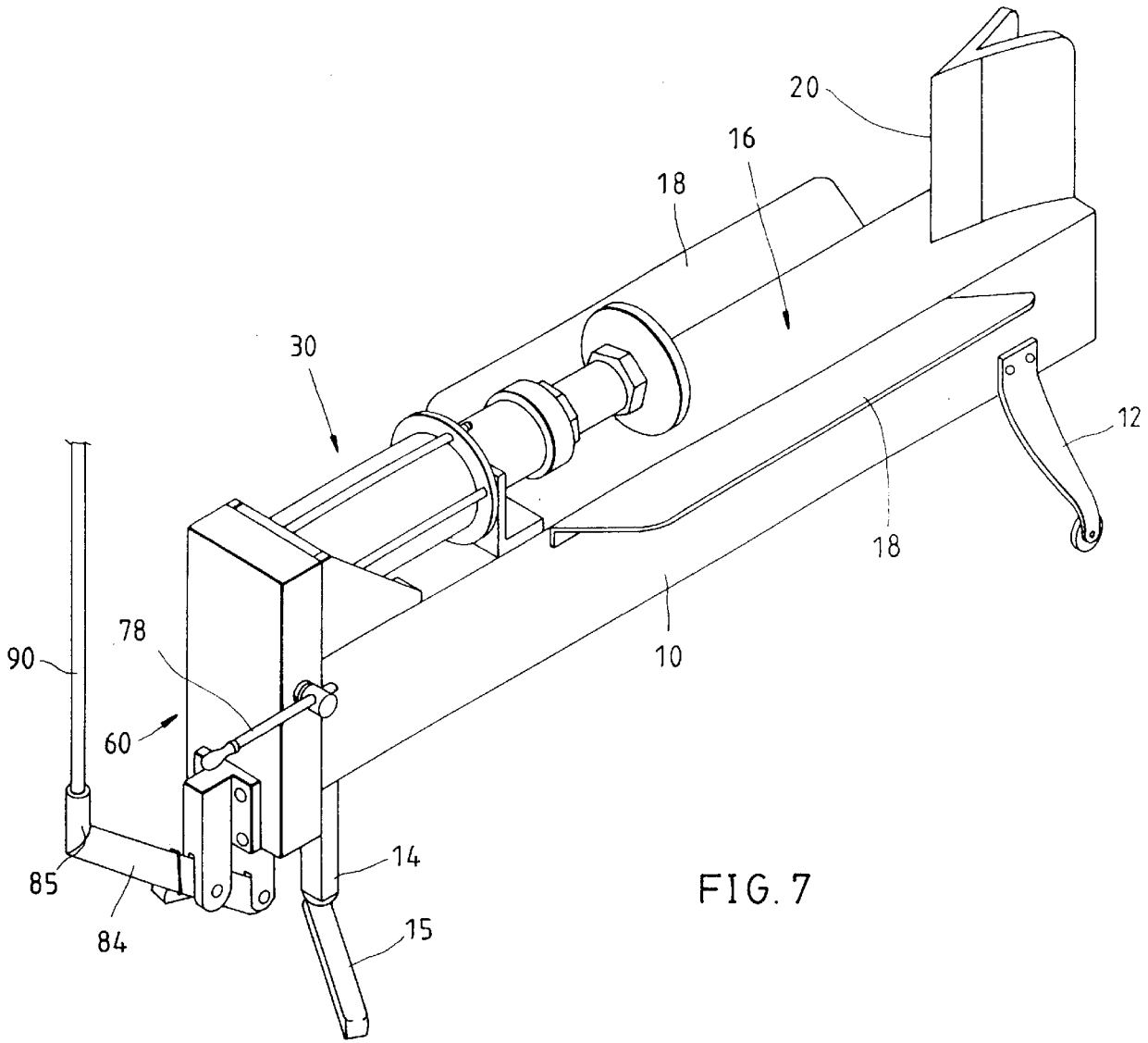
FIG. 7 shows a perspective view of the structural relationship between a press rod and a long rod of the first preferred embodiment of the present invention.

As shown in FIG. 7, the press rod 84 is provided at the free end thereof with a tubular portion 85 for fitting a long rod 90 which is intended to facilitate the easy linking of the press rod 84.

Figure 8:
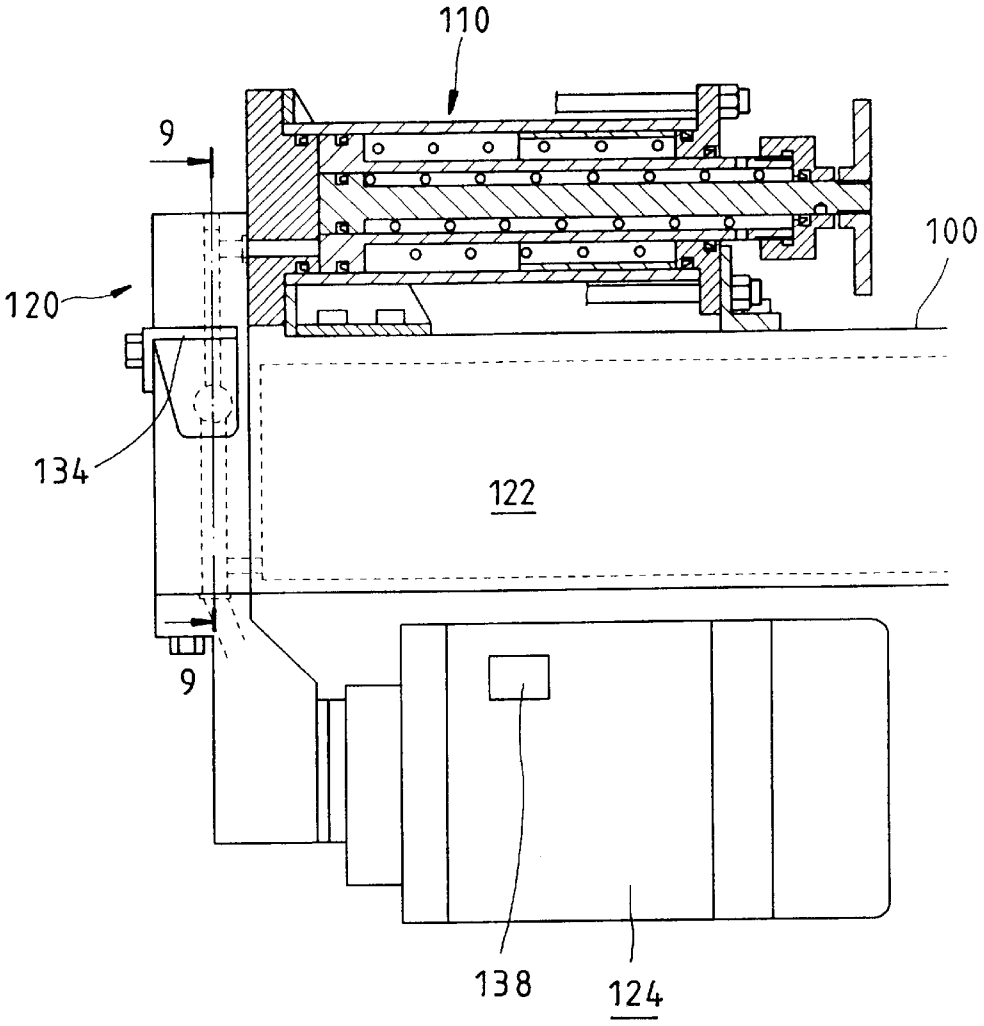
FIG. 8 shows a sectional view of a second preferred embodiment of the present invention, with the sectional view being taken in the direction similar to the line 2—2 as shown in FIG. 1.
Figure 9:
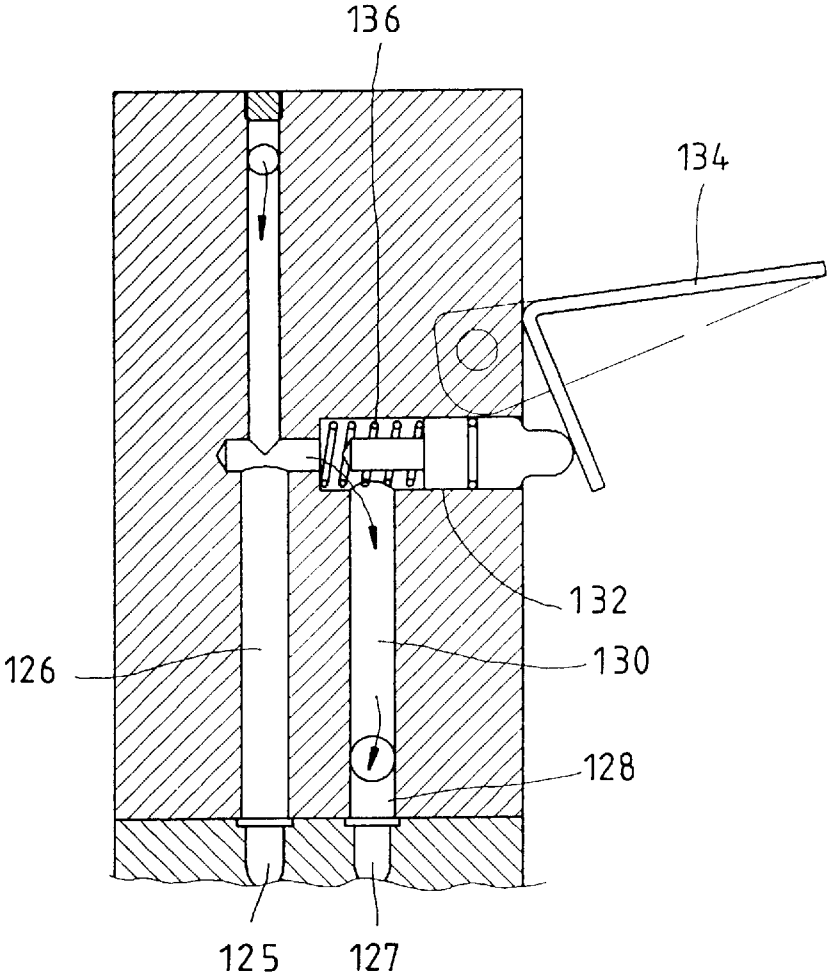
FIG. 9 shows a sectional view of a portion taken in the direction indicated by a line 9—9 as show in FIG. 8.
Figure 10:
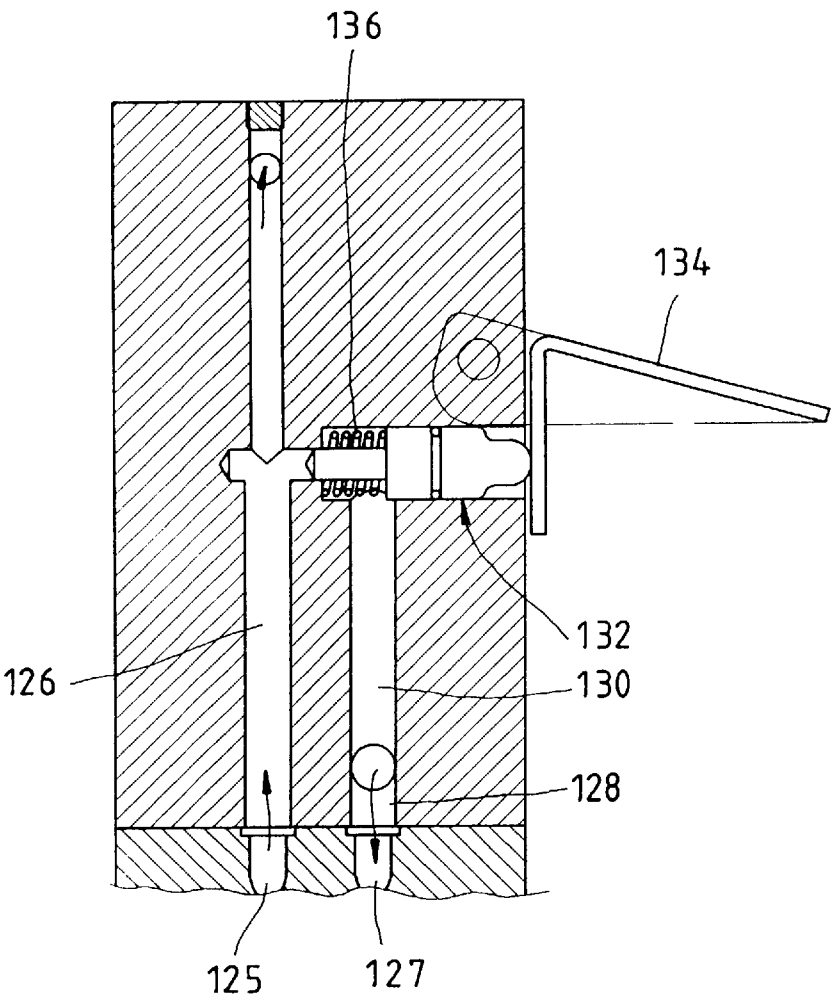
FIG. 10 shows a sectional view similar to FIG. 9 to illustrate the "OFF" state of the oil returning switch of the second preferred embodiment of the present invention.

Referring to FIGS. 8–10, a firewood splitting machine of the second preferred embodiment of the present invention is basically similar in construction to that of the first preferred embodiment described above, with the difference being that the former is provided with an oil injecting device 120 which is operated electrically rather than manually as in the first preferred embodiment and is composed of an oil storage cylinder 122, an electric pump 124, an oil injecting pathway 126 in communication with an oil pressure cylinder 110 and an oil outlet 125 of the electric pump 124, an oil supplying pathway 128 connecting the oil storage cylinder 122 and an oil inlet 127 of the electric pump 124, an oil returning pathway 130 in communication with the oil pressure cylinder 110 and the oil storage cylinder 122. The oil returning pathway 130 is connected at one end thereof with the oil injecting pathway 126 and at another end thereof with the oil supplying pathway 128. The oil returning pathway 130 is provided with an oil returning switch 132 for opening or closing the oil returning pathway 130. A press plate 134 is used to control the "ON" or the "OFF" state of the oil returning switch 132. The oil returning switch in the static state is urged by a spring 136 to press against the press plate 134 so as to keep the oil returning pathway 130 to remain in the open state, as shown in FIG. 9. In operation, the press plate 134 is pressed with one hand while the switch 138 of the electric pump 124 is pressed with another hand. As the press plate 134 is pressed, as illustrated in FIG. 10, the oil returning pathway 130 is obstructed by the oil returning switch 132. The oil in the oil storage cylinder 122 is pumped by the electric pump 124 into the oil pressure cylinder 110 mounted on the support frame 100. The oil pressure cylinder 110 is thus actuated to work. As the press plate 134 and the switch 138 of the electric pump 124 are relieved of the pressures of both hands of the operator, the electric pump 124 stops. In the meantime, the oil returning pathway 130 is once again opened up, as shown in FIG. 9, so as to enable the oil in the oil pressure cylinder 110 to flow back into the oil storage cylinder 122. Whenever only the electric pump 124 is at work, the oil that is pumped out by the electric pump 124 is forced to flow back via the oil returning pathway 130. In the meantime, the oil pressure cylinder 110 is no longer at work so as to safeguard the machine operator.

What is claimed is:

1. A wood splitting machine comprising:

a support frame;

a cutter mounted on one end of a longitudinal axis of said support frame for splitting wood;

an oil pressure cylinder mounted on another end of the longitudinal axis of said support frame and composed of a cylindrical body provided at both ends thereof with a front end cover and a rear end cover, a piston slidable in said cylindrical body, a rod member fastened at one end thereof with said piston such that another end of said rod member juts out of said front end cover, a through hole extending along a longitudinal axis of said rod member such that said through hole is extended through both ends of said rod member and said piston, a subsidiary piston slidable in said through hole, a subsidiary rod member fastened at one end thereof with said subsidiary piston such that another end of said subsidiary rod member juts out of said through hole, and a press plate fastened with said another end of said subsidiary rod member for forcing the wood to move toward said cutter, an expandable chamber within said pressure cylinder formed between said piston, subsidiary piston, through hole and rear cover which expands when oil is injected into said expandable chamber; and oil injecting means mounted on said support frame for injecting the oil into said expandable chamber to slide said press plate and split the wood on the cutter.

2. The wood splitting machine as defined in claim 1, wherein said oil injecting means comprise:

an oil storage cylinder;

an oil injecting chamber;

an oil injecting pathway in communication with said oil injecting chamber and said expandable chamber;

an oil injecting check valve located in said oil injecting pathway to permit one-way flow of oil from said oil injecting chamber into said expandable chamber through said oil injecting pathway;

an oil supplying pathway in communication with said oil storage cylinder and said oil injecting chamber;

an oil supplying check valve located in said oil supplying pathway to permit one-way flow of oil from said oil storage cylinder into said oil injecting chamber through said oil supplying pathway;

an oil returning pathway in communication with said oil storage cylinder and said expandable chamber;

an oil returning switch for closing and opening said oil returning pathway; and an oil injecting piston slidable in said oil injecting chamber for pumping oil from said oil injecting chamber into said expandable chamber.

3. The wood splitting machine as defined in claim 2, wherein said oil injecting piston has a piston rod fastened at a first end thereof with said oil injecting piston and a second end thereof pivotally fastened with a press rod, said press rod rotatably engaged with a fulcrum, and wherein a free end of said press rod can be actuated by hand by a machine operator; and a recovery spring urging at one end thereof an outer wall of said oil injecting chamber and urging at another end thereof said piston rod for enabling said oil injecting piston to return to an original position thereof from a displacement position thereof.

4. The wood splitting machine as defined in claim 3, wherein said free end of said press rod is provided with a rod fastened therewith to facilitate actuation of said press rod by the hand of the machine operator.

5. The wood splitting machine as defined in claim 2, wherein said oil storage cylinder is housed in said support frame.

6. The wood splitting machine as defined in claim 1, wherein said support frame is provided with two support legs fastened therewith, one of said two support legs being provided at a free end thereof with an auxiliary leg fastened rotatably therewith.

7. The wood splitting machine as defined in claim 1, wherein said oil injecting means is provided with an electric pump for injecting oil into said oil pressure cylinder.

8. The wood splitting machine as defined in claim 7, wherein said oil injecting means comprises:

an oil storage cylinder;

an oil injecting pathway in communication with said oil pressure cylinder and an oil outlet of said electric pump;

an oil supplying pathway in communication with said oil storage cylinder and an oil inlet of said electric pump;

an oil returning pathway in communication with said oil pressure cylinder and said oil storage cylinder; and an oil returning switch located in said oil returning pathway for closing and opening said oil returning pathway.

9. The wood splitting machine as defined in claim 8, wherein said oil returning switch is urged by a spring to urge a press plate to open said oil returning pathway when said oil returning switch is unactuated; and wherein said oil returning switch is actuated to obstruct said oil returning pathway when said press plate is pressed.

* * * * *